US008536103B2

(12) United States Patent
Denis et al.

(10) Patent No.: US 8,536,103 B2
(45) Date of Patent: Sep. 17, 2013

(54) LIQUID EXTREME PRESSURE ADDITIVE

(76) Inventors: Richard A. Denis, Conroy, TX (US); Matthew R. Sivik, Broadview Heights, OH (US); William C. Ward, Jr., Perry, OH (US)

( * ) Notice: Subject to any disclaimer, the term of this patent is extended or adjusted under 35 U.S.C. 154(b) by 201 days.

(21) Appl. No.: 12/865,886

(22) PCT Filed: Feb. 25, 2009

(86) PCT No.: PCT/US2009/035094

§ 371 (c)(1),
(2), (4) Date: Oct. 19, 2010

(87) PCT Pub. No.: WO2009/111235

PCT Pub. Date: Sep. 11, 2009

(65) Prior Publication Data

US 2011/0028363 A1 Feb. 3, 2011

Related U.S. Application Data

(60) Provisional application No. 61/032,482, filed on Feb. 29, 2008.

(51) Int. Cl.
*C10M 133/00* (2006.01)
*C10M 133/46* (2006.01)

(52) U.S. Cl.
USPC ..... 508/232; 508/224; 508/225; 508/227; 508/228; 508/231; 508/237; 508/242; 508/419; 508/420; 508/543

(58) Field of Classification Search
USPC ..... 508/227, 228, 231, 232, 237, 242, 508/419, 420, 543, 224, 225
See application file for complete search history.

(56) References Cited

U.S. PATENT DOCUMENTS

| | | | | |
|---|---|---|---|---|
| 3,914,241 | A | 10/1975 | Elliott et al. | |
| 4,107,168 | A | 8/1978 | Okorodudu | |
| 4,188,299 | A | 2/1980 | Caspari | |
| 4,425,248 | A * | 1/1984 | Piotrowski et al. | 508/165 |
| 4,705,642 | A | 11/1987 | Sung et al. | |
| 4,908,144 | A * | 3/1990 | Davis et al. | 508/274 |
| 5,102,568 | A | 4/1992 | King et al. | |
| 5,205,845 | A | 4/1993 | Sacks et al. | |
| 5,407,592 | A * | 4/1995 | Cheng et al. | 508/225 |
| 5,538,520 | A | 7/1996 | Avery et al. | |
| 5,585,029 | A | 12/1996 | Kim et al. | |
| 5,853,435 | A | 12/1998 | Avery et al. | |
| 6,528,458 | B1 * | 3/2003 | Tagliamonte et al. | 508/185 |
| 2005/0041395 | A1 * | 2/2005 | Tipton et al. | 361/715 |
| 2009/0298728 | A1 * | 12/2009 | Brouse et al. | 508/272 |

FOREIGN PATENT DOCUMENTS

| | | | |
|---|---|---|---|
| WO | WO 2006066068 | A2 * | 6/2006 |
| WO | 2006091387 | | 8/2006 |

OTHER PUBLICATIONS

Search Report from corresponding PCT Publication No. WO 2009/111235 A3 published Jan. 28, 2010.
Written Opinion from corresponding PCT Application No. PCT/2009/035094; date of mailing: Nov. 20, 2009.

* cited by examiner

*Primary Examiner* — Taiwo Oladapo
(74) *Attorney, Agent, or Firm* — Christopher D. Hilker

(57) ABSTRACT

A liquid extreme pressure agent for use in lubricating compositions where the lubricating compositions comprise an oil of lubricating viscosity and the reaction product of: (a) a thiazole; (b) a composition comprising a carboxylic acid, a phosphorus containing acid or salt, or combinations thereof; and (c) an amine containing one or more branched hydrocarbyl groups. The invention also provides an additive composition comprising the reaction product described above and a process for making lubricating compositions, including greases, from the reaction product.

10 Claims, No Drawings

LIQUID EXTREME PRESSURE ADDITIVE

BACKGROUND OF THE INVENTION

The present invention relates to a liquid extreme pressure additive for use in lubricating compositions.

A variety of additives are used in lubricants to substantially improve performance. For example, extreme pressure additives are routinely incorporated into an untreated lubricating composition (e.g., greases) to significantly improve performance. Extreme pressure additives are believed to produce a film on the surface of a metal which can both increase the load carrying capacity of lubricant, and protects the metal surface under high load conditions from deterioration due to wear, welding, and abrasion.

Lead naphthenates and lead dialkyldithiocarbamates were frequently used as additives to improve the EP performance of greases. However, lead is a heavy metal which is considered poisonous in all forms. As an alternative, metal additives (such as antimony, zinc, and bismuth) have been used as a replacement for lead. However, these heavy metals still provide environmental concerns regarding their use. Accordingly, it has long been a goal in the art to develop non-metal lubricating materials to replace heavy metal additives while providing acceptable extreme pressure performance.

The effectiveness of potential extreme pressure additives is conventionally ascertained by the 4-Ball Weld Test (ASTM D-2596) and the Timken Load Test (ASTM D-2509). An ideal candidate compound should exhibit good results in both tests since each test is directed to different extreme pressure properties.

Some 2,5-dimercapto-1,3,4-thiadiazole (DMTD) derivatives can be effective as anti-wear additives in lubricants. Examples of DMTD derivatives useful as anti-wear additives include: the monosulfide and disulfide dimers of DMTD as disclosed in U.S. Pat. Nos. 4,517,103 and 5,194,621; maleate adducts of DMTD as disclosed in U.S. Pat. Nos. 5,102,568, 5,055,584 and 5,138,065; and mono-alkylated and thioacteal derivatives as disclosed in U.S. Pat. No. 5,849,925.

International Application PCT/US 2005/045559, published as WO 2006/066068A2 on Jun. 22, 2006, discloses a composition comprising an oil of lubricating viscosity and a mixture of at least one dimercaptothiadiazole polymer or derivative thereof and at least one unsaturated carboxylic acid.

U.S. Pat. No. 6,489,484, Karol, et al., Dec. 3, 2002, discloses thiadiazole-poly(ether)glycol reaction products and adducts useful as extreme pressure additives.

U.S. Pat. No. 6,365,557, Karol, et al., Apr. 2, 2002, discloses 2,5-dimercapto-1,3,4-thiadiazole dimer-poly(ether) glycol reaction products and adducts useful as extreme pressure additives.

There are some DMTD-based derivatives that can provide acceptable 4-Ball Weld properties. Unfortunately, these same derivatives generally exhibit poor Timken Load performance since the DMTD derivatives do not generally provide Timken Loads levels greater than 35 pounds. As a result, commercialization of DMTD derivatives as extreme pressure additives has been limited. The use of some DMTD derivatives are also limited due to their insolubility in oil, making it difficult to utilize them in oil-based lubricating compositions.

In view of the above, there exists a need in the art for DMTD derivatives that provide both adequate 4-Ball Weld and Timken Load properties and which can be easily used in oil-based lubricating compositions. Accordingly, it is an object of the present invention to provide DMTD derivatives that provide adequate 4-Ball Weld and Timken Load properties, which will allow for the effective utilization of DMTD derivatives as extreme pressure additives.

SUMMARY OF THE INVENTION

The invention provides a lubricating composition comprising an oil of lubricating viscosity and the reaction product of: (a) an unsubstituted thiazole; (b) a composition comprising (i) a carboxylic acid or anhydride with at least one hydrocarbon group of 2 to 75 carbon atoms, (ii) a phosphorus acid or salt thereof, or combinations thereof; and (c) an amine containing one or more branched hydrocarbyl groups.

The invention also provides an additive composition comprising the reaction product described above.

The invention also provides a process for preparing a grease composition comprising combining under grease-forming conditions of heating and mixing an oil of lubricating viscosity and the reaction product described above.

The invention also provides a process for preparing a grease composition comprising mixing a grease composition and the reaction product described above.

The invention also provides a use of the compositions described above for imparting to a grease at least one improved property selected from the group consisting of extreme pressure properties and antiwear properties.

DETAILED DESCRIPTION OF THE INVENTION

Various preferred features and embodiments will be described below by way of non-limiting illustration.

Components (a), (b), and (c) may be combined in any order or simultaneously. In one embodiment the reaction is carried out in a typical amount of diluent oil. In another embodiment the reaction is carried out by mixing components (a) and (b) in approximately equal molar amounts and then adding a molar amount of component (c). The reaction may be carried out at various temperatures but in one embodiment the components may be combined at temperatures of 30 to 60 degrees Celsius and the reaction mixture may be heated to temperatures up to 120 degrees Celsius and held until the reaction is complete. In one embodiment the reaction mixture is heated to 110 to 150 degrees Celsius until no solids are visible in the mixture. The reaction product is generally a clear liquid, solid, semi-solid, or mixture thereof.

Components (a), (b) and (c) may be combined to form the desired reaction product in ratios that are not significantly limited. In one embodiment the molar ratios of (a):(b) may be from 5:1 to 1:5, in another embodiment from 2:1 to 1:2 and in yet additional embodiments from 1.5:1 to 1:1.5 and from 1.1:1 to 1:1.1. In one embodiment the molar ratios of (a):(c) may be from 10:1 to 1:10, in another embodiment from 5:1 to 1:5 and in yet additional embodiments from 2:1 to 1:2 and from 1.5:1 to 1:1.5. In one embodiment of the present invention (a) is 2,5-dimercapto-1,3,4-thiadiazole and (b) is one or more mono-carboxylic acids used alone or in combination with a phosphorus containing acid. In another embodiment (c) is a mixture of C12-C14 tert-alkyl primary amines. In yet another embodiment, the molar ratios of components (a):(b) are from 2:1 to 1:3, or from 1:1 to 1:2.5, and the molar ratios of components (a):(c) are from 2:1 to 1:3, or from 1:1 to 1:2.

The reaction of the components described above result in a mixture of amine salts. When a suitable amine, as described above, is used, the resulting product is a liquid which is soluble in lubricating oils and that can be used in grease and other lubricant compositions. The invention provides a liquid extreme pressure additive that can be easily added to and used in various compositions, providing a benefit over solid extreme pressure agents. The liquid extreme pressure agents of the current invention also give good performance as shown in the examples below. While the detailed chemical structures of the resulting product are not clearly known, they are believed to comprise salts or other complexes of the materials (a), (b) and (c). Completion of the reaction is practically determined by observing the solubility of the product in oil, since at least some of the starting materials are typically insoluble or only slightly soluble in oil.

Oil of Lubricating Viscosity

One element of the present invention is an oil of lubricating viscosity, also referred to as a base oil. The base oil used in the inventive lubricating oil composition may be selected from any of the base oils in Groups I-V as specified in the American Petroleum Institute (API) Base Oil Interchangeability Guidelines. The five base oil groups are as follows:

| Base Oil Category | Sulfur (%) | | Saturates (%) | Viscosity Index |
|---|---|---|---|---|
| Group I | >0.03 | and/or | <90 | 80 to 120 |
| Group II | <0.03 | and | >90 | 80 to 120 |
| Group III | <0.03 | and | >90 | >120 |
| Group IV | All polyalphaolefins (PAOs) | | | |
| Group V | All others not included in Groups I, II, III or IV | | | |

Groups I, II and III are mineral oil base stocks. The oil of lubricating viscosity, then, can include natural or synthetic lubricating oils and mixtures thereof. Mixtures of mineral oil and synthetic oils, particularly polyalphaolefin oils and polyester oils, are often used.

Natural oils include animal oils, vegetable oils, and esters thereof (e.g. castor oil, lard oil and other vegetable acid esters) as well as mineral lubricating oils such as liquid petroleum oils and solvent-treated or acid treated mineral lubricating oils of the paraffinic, naphthenic or mixed paraffinic-naphthenic types. Hydrotreated or hydrocracked oils are included within the scope of useful oils of lubricating viscosity.

Oils of lubricating viscosity derived from coal or shale are also useful. Synthetic lubricating oils include hydrocarbon oils and halosubstituted hydrocarbon oils such as polymerized and interpolymerized olefins and mixtures thereof, alkylbenzenes, polyphenyl, (e.g., biphenyls, terphenyls, and alkylated polyphenyls), alkylated diphenyl ethers and alkylated diphenyl sulfides and their derivatives, analogs and homologues thereof.

Alkylene oxide polymers and interpolymers and derivatives thereof, and those where terminal hydroxyl groups have been modified by, for example, esterification or etherification, constitute other classes of known synthetic lubricating oils that can be used.

Another suitable class of synthetic lubricating oils that can be used comprises esters such as, the esters of dicarboxylic acids, and those made from C5 to C12 monocarboxylic acids and polyols or polyol ethers. Other synthetic lubricating oils include liquid esters of phosphorus-containing acids, polymeric tetrahydrofurans, silicon-based oils such as the polyalkyl-, polyaryl-, polyalkoxy-, or polyaryloxy-siloxane oils, and silicate oils.

Hydrotreated naphthenic oils are also known and can be used, as well as oils prepared by a Fischer-Tropsch gas-to-liquid synthetic procedure followed by hydroisomerization.

Unrefined, refined and rerefined oils, either natural or synthetic (as well as mixtures of two or more of any of these) of the type disclosed hereinabove can used in the compositions of the present invention. Unrefined oils are those obtained directly from a natural or synthetic source without further purification treatment. Refined oils are similar to the unrefined oils except they have been further treated in one or more purification steps to improve one or more properties. Rerefined oils are obtained by processes similar to those used to obtain refined oils applied to refined oils which have been already used in service. Such rerefined oils often are additionally processed by techniques directed to removal of spent additives and oil breakdown products.

The Thiazole

Another element of the present invention is the thiazole. Thiazoles are compounds which contain both a sulfur atom and a nitrogen atom in a five member ring. The term "thiazole" is thus used herein generically to encompass both thiazoles proper, that is, materials containing one nitrogen atom and one sulfur atom in the ring, as well as thiadiazoles, that is, materials containing sulfur and two nitrogen atoms in the ring. The term "unsubstituted thiazole" as used herein is intended to include thiazoles, thiadiazoles, dimercapto thiadiazoles, and benzothiazoles where the substituent groups attached to the ring structure(s) are independently —$S_nH$ where n is 0 to 3, and in some embodiments 0 to 2.

Thiadiazoles are discussed by W. R. Sherman, "The Thiadiazoles," in Heterocyclic Compounds, Volume 7, R. C. Elderfield, Editor, John Wiley & Sons, Inc., New York, pages 541-626, 1961; the synthesis and properties of many thiadiazoles are described in this reference.

One type of thiazole is the benzothiazoles, that is, compounds having the general structure:

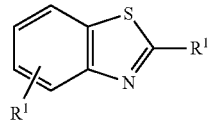

where $R^1$ is an optional substituent, described in greater detail below.

Another type of thiazole compound is the thiadiazole. Thiadiazoles can generally have any of the following nuclear structures:

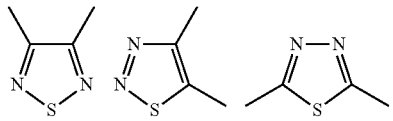

the third of which being the most important. The thiadiazoles generally have the structure:

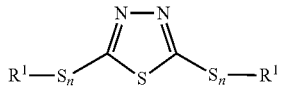

Where each n is independently 0-2 and $R^1$ is an optional substituent, described in greater detail below. In one embodiment each n is 1 or 2.

The $R^1$ groups in the structures above are each independently hydrogen or a sulfur and hydrogen group (—SH). While, generally speaking, thiazoles may also contain hydrocarbyl substituent groups, which may provide the compound with a measure of oil solubility, the present invention deals with unsubstituted thiazoles, that is thiazoles and thiadiazoles where all $R^1$ groups are either —H or —SH. In one embodiment these unsubstituted thiazoles are dimercaptothiadiazoles, benzothiazoles, or mixtures thereof. These unsubstituted thiadiazoles are more difficult to use in oil-based lubricating compositions due to their lack of oil solubility. One objective of the present inventive is to allow for use of these unsubstituted thiazoles as liquid extreme pressure agents.

Dimercaptothiadiazoles suitable for use in the invention include: 2,5-dimercapto-1,3,4-thiadiazole; 3,5-dimercapto-1,2,4-thiadiazole; 3,4-dimercapto-1,2,4-thiadiazole; 4,5-dimercapto-1,2,3-thiadiazole; 3-methylmercapto-5-mercapto-1,2,4-thiadiazole; and combinations thereof. Mixtures of benzothiazoles and dimercaptothiadiazoles may also be used.

The compound which is most readily available for purposes of the present invention, is 2,5-dimercapto-1,3,4-thiadiazole, sometimes referred to herein as "DMTD." It should be understood, however, that the term DMTD, as used herein, can encompass any of the dimercaptothiadiazoles, mixtures of two or more dimercaptothiadiazoles, or derivates thereof. In one embodiment, the DMTD is a non-polymer, or free of polymers of DMTD. In one embodiment, the invention is free of DMTD oligomers, dimers, or trimers. A convenient preparation of 2,5-dimercapto-1,3,4-thiadiazole is the reaction of 1 mole of hydrazine or a salt of hydrazine with 2 moles of carbon disulfide in an alkaline medium. The product can be recovered by acidification of the reaction mixture.

The Acids

Acids suitable for use in the invention include a carboxylic acid or anhydride with at least one hydrocarbon group of 2 to 75 carbon atoms, one or more phosphorus containing acids or salts thereof, or mixtures thereof. In one embodiment the carboxylic acid or anhydride is a mono-carboxylic acid, a hydrocarbon-substituted succinic acid or anhydride, or combinations thereof.

Suitable carboxylic acids are represented by the formula $R^3(COOH)_n$ where $R^3$ is hydrocarbon group of 2 to 74 carbon atoms, and n is an integer of from 1 to 4. In one embodiment, n is 1 or 2, and in another embodiment n is 1. In one embodiment, $R^3$ contains 8 to 30 carbon atoms. In another embodiment, $R^3$ contains 12 to 20 carbon atoms. $R^3$ can be an alkyl or alkenyl group, either straight chained or branched. Examples of such carboxylic acids include lauric acid, myristic acid, palmitic acid, stearic acid, isostearic acid, arachic acid, behenic acid, citronellic acid, 12-hydroxystearic acid, lignoceric acid, cerotic acid, montanic acid, melissic acid, caproleic acid, oleic acid, elaidic acid, linoleic acid, coconut oil fatty acid, soy bean fatty acid, tall oil fatty acid, fish oil fatty acid, rapeseed oil fatty acid, tallow oil fatty acid, and palm oil fatty acid.

In one embodiment the carboxylic acids used with the invention are fully saturated, that is there are no carbon-carbon double bonds present in the alkyl group of the acid. Such acids include myristic acid, stearic acid, isostearic acid, 12-hydroxystearic acid, palmitic acid, behenic acid, lignoceric acid, montanic acid, and melissic acid. In one embodiment, the acids used in the present invention contain from 50 to 75 carbon atoms and in another embodiment from 55 to 75 carbon atoms.

Additional acids suitable for use in the invention include phosphorus acids, such as phosphoric acid and phosphonic acid, and the esters, amine salts and other derivatives thereof, such as hydroxyalkane phosphonic acids. Salts of these materials include those formed by the reaction of the phosphorus containing acid with an amine.

The hydroxyalkane phosphonic acids of the present invention can include compounds defined by the following general formula:

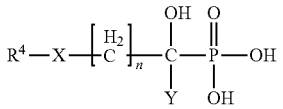

wherein X is oxygen, sulfur or a secondary amino group; n is an integer from 1 to 8; and $R^4$ is an alkyl group having from 1 to 100 carbon atoms; Y is a phosphonic acid group; n is an integer from 2 to 4, and in one embodiment can be 3; and X can be oxygen or sulfur. $R^4$ is also useful when it is an alkyl group containing from 1 to 30 carbon atoms. In one embodiment $R^4$ is an alkyl group having from 6 to 4 carbon atoms, and in another embodiment from 8 to 18 carbon atoms The preparation of the hydroxyalkane phosphonic acids occurs by the reaction of a carboxylic acid with phosphorous acid and phosphorus trichloride. The carboxylic acid has an oxygen atom, sulfur atom or secondary amino group in the main backbone of the carboxylic acid. The carboxylic acid is added to a flask and heated to 70 degrees Celsius to 150 degrees Celsius. Phosphorous acid is added to the reaction. Phosphorus trichloride is then added dropwise to the reaction, and the reaction is continued until no more hydrogen chloride is evolved. Usually the reaction takes from 1 to 4 hours.

Phosphate ester salts derived from phosphorus containing acids may also be used. Such acids comprise alkyl amine salts of mono- and di-esters of phosphoric acid and/or phosphonic acid, where the alkyl groups of the amines can contain from 1 to 60 carbon atoms, from 1 to 30 carbon atoms, or from 12 to 18 carbon atoms.

The phosphate ester salt may be a monohydrocarbyl, dihydrocarbyl or a trihydrocarbyl phosphate, wherein each hydrocarbyl group is saturated. In one embodiment, each hydrocarbyl group independently contains from 8 to 30, or from 12 to 28, or from 14 to 24, or from 14 to 18 carbons atoms. In one embodiment, the hydrocarbyl groups are alkyl groups. Examples of hydrocarbyl groups include tridecyl, tetradecyl, pentadecyl, hexadecyl, heptadecyl, octadecyl groups and mixtures thereof.

In one embodiment, the phosphate ester salt is a phosphorus acid ester reacted with an amine where the phosphorus acid ester is prepared by reacting one or more phosphorus acids or anhydrides with a saturated alcohol. The phosphorus acid or anhydride is generally an inorganic phosphorus reagent, such as phosphorus pentoxide, phosphorus trioxide, phosphorus tetroxide, phosphorous acid, phosphoric acid, phosphorus halide, or lower alkyl phosphorus esters, and the like.

Examples of commercially available alcohols and alcohol mixtures used to prepare the phosphorus acid esters or salts include Alfol 1218™ (a mixture of synthetic, primary, straight-chain alcohols containing 12 to 18 carbon atoms); Alfol 20+™ alcohols (mixtures of $C_{18}$-$C_{28}$ primary alcohols having mostly $C_{20}$ alcohols); and Alfol 22+™ alcohols ($C_{18}$-$C_{28}$ primary alcohols containing primarily $C_{22}$ alcohols). Alfol alcohols are available from Vista Chemical Company. Another example of a commercially available alcohol mixture is Adol 60™ (75% by weight of a straight chain $C_{22}$ primary alcohol, 15% of a $C_{20}$ primary alcohol and 8% of $C_{18}$ and $C_{24}$ alcohols). The Adol alcohols are marketed by Ashland Chemical.

Additional alcohols may be used, such as mixtures of monohydric fatty alcohols derived from naturally occurring triglycerides available from Procter & Gamble Company and the Neodol™ products available from Shell Chemical Co.

The phosphate salts may be prepared by reacting an acidic phosphate ester with an amine compound or a metallic base to form an amine or a metal salt. The amines may be monoamines or polyamines and/or any of the amines described below. Useful amines include those amines disclosed in U.S. Pat. No. 4,234,435 at Col. 21, line 4 to Col. 27, line 50, these passages being incorporated herein by reference.

The monoamines generally contain a hydrocarbyl group which contains from 1 to 30 carbon atoms, or from 1 to 12, or from 1 to 6. In one embodiment, the amine is a fatty ($C_{8-30}$) amine. Other useful amines include primary ether amines, tertiary-aliphatic primary amines, secondary amines, hydroxyamines, hydroxyhydrocarbyl amines which contains at least one NH group, fatty diamines, alkylene polyamines, ethylenepolyamine, heterocyclic polyamines.

The metal salts of the phosphorus acid esters are prepared by the reaction of a metal base with the acidic phosphorus ester. The metal base may be any metal compound capable of forming a metal salt. Examples of metal bases include metal oxides, hydroxides, carbonates, borates, or the like. The metals of the metal base include Group IA, IIA, IB through VIIB, and VIII metals (CAS version of the Periodic Table of the Elements). These metals include the alkali metals, alkaline earth metals and transition metals. In one embodiment, the metal is a Group IIA metal, such as calcium or magnesium, Group IIB metal, such as zinc, or a Group VIIB metal, such as manganese. Preferably, the metal is magnesium, calcium, manganese or zinc. Examples of metal compounds which may be reacted with the phosphorus acid include zinc hydroxide, zinc oxide, copper hydroxide, copper oxide, etc.

Acids suitable for use in the invention also include hydrocarbon-substituted succinic acids or anhydrides thereof wherein the hydrocarbon group contains 2 to 30 carbon atoms, and in one embodiment 8 to 24 carbon atoms, and in one embodiment 12 to 20 carbon atoms. In one embodiment the acid can be polyisobutylene succinic acid, polypropenylene succinic acid, tetrapropylene succinic acid, or mixtures thereof.

Mixtures of the various (b)(i) carboxylic acids, (b)(ii) phosphorus containing acids and the salts and esters thereof may also be used in the invention. Such mixtures can have a weight ratio of components (b)(i):(b)(ii) that in one embodiment range from 1:99 to 99:1, in another embodiment range from 10:90 to 90:10 and in yet another embodiment range from 30:70 to 70:30.

The Amine

The amines of the present invention comprise an amine containing one or more branched hydrocarbyl groups. The amine can either be a polyamine or a monoamine. The amine can also contain unsaturated hydrocarbon groups therein but in another embodiment may contain saturated hydrocarbon groups. Suitable amines include hydrocarbyl amines having from 2 to about 100 carbon atoms and in one embodiment from 2 to 60 carbon atoms, aromatic amines, or combinations thereof, e.g., aliphatic substituted aromatic amines. In one embodiment the hydrocarbyl group is an alkyl group. In another embodiment the amine is a sterically hindered amine.

Hydrocarbyl amines suitable for the present invention can have the formula $(R^5)_3C—N(R^6)_2$ wherein each $R^5$ is independently hydrogen or a hydrocarbyl such as aromatic, aliphatic, or combinations thereof. Regardless of the makeup or content of any particular set of $R^5$ substituents, collectively the $R^5$ substituents have a total of 2 to 60 carbon atoms, and in another embodiment 2-30 carbon atoms. That is, at least one of the $R^5$ substituents must contain at least two carbon atoms therein or at least two of the $R^5$ substituents must contain at least one carbon atoms therein. In one embodiment each $R^5$ substituent is independently hydrogen or an alkyl group. In another embodiment the total number of carbon atoms of the $R^5$ groups is from 12 to 14. Considering $R^6$, each $R^6$ is independently hydrogen or a hydrocarbyl group. However, collectively the two $R^6$ groups have from 0 to 30 carbon atoms. In one embodiment, the two $R^6$ groups are alkyl having a total of 0 to 4 carbon atoms, and in another embodiment both are hydrogen.

In one embodiment, the amines used in the invention are primary amines containing one or more branched hydrocarbyl groups, including fatty primary amines, primary ether amines, and tertiary aliphatic amines. The amines used in the invention may also be a mixture of one or more amines that include at least one amine containing one or more branched hydrocarbyl groups but which may also include other amines such as linear amines. Examples of primary amines include ethylamine, propylamine, butylamine, 2-ethylhexylamine, octylamine, and dodecylamine. In one embodiment, the primary amine is a fatty ($C_{8-30}$) amine, which include n-octylamine, n-decylamine, n-dodecylamine, n-tetradecylamine, n-hexadecylamine, n-octadecylamine, oleylamine, etc. Other useful fatty amines include commercially available fatty amines, such as Armeen™ amines (products available from Akzo Chemicals, Chicago, Ill.). These amines include Armeen C™, Armeen O™, Armeen OL™, Armeen T™, Armeen HT™, Armeen S™ and Armeen SD™, wherein the letter designation relates to the fatty group, such as cocoa, oleyl, tallow, or stearyl groups.

In one embodiment, the amine is a tertiary-aliphatic primary amine. Generally, the aliphatic group, preferably an alkyl group, contains from 4 to 30, or from 6 to 24, or from 8 to 22 carbon atoms. Such amines are illustrated by tert-butylamine, tert-hexylamine, 1-methyl-1-amino-cyclohexane, tert-octylamine, tert-decylamine, tert-dodecylamine, tert-tetradecylamine, tert-hexadecylamine, tert-octadecylamine, tert-tetracosanylamine, and tert-octacosanylamine.

Mixtures of tertiary-aliphatic primary amines are also useful for the purposes of this invention. Illustrative of amine mixtures of this type are Primene 81R™ which is a mixture of $C_{12}$-$C_{14}$ tertiary alkyl primary amines and Primene JMT™ which is a similar mixture of $C_{18}$-$C_{22}$ tertiary alkyl primary amines (both are available from Rohm and Haas Company). The tertiary alkyl primary amines and methods for their preparation are known to those of ordinary skill in the art. The tertiary alkyl primary amines and methods for their preparation are described in U.S. Pat. No. 2,945,749 which is hereby incorporated by reference for its teaching in this regard.

In another embodiment, the amine is a secondary amine. Specific of secondary amines include dimethylamine, diethylamine, dipropylamine, dibutylamine, diamylamine, dihexylamine, diheptylamine, methylethylamine, ethylbutylamine, ethylamylamine and the like. In one embodiment, the secondary amines may be cyclic amines, such as piperidine, piperazine, morpholine, etc.

In one embodiment the amine comprises 2-ethylhexylamine, 3-aminoheptane, tert-octylamine, 1,5-dimethylhexylamine, N-methylhexylamine, 1,3-dimethylbutylamine, bis-2-ethylhexylamine, a mixture of tertiary alkyl amines where the alkyl groups of the amines each independently contain from 12 to 14 carbon atoms, and mixtures thereof. In one embodiment the mixture of tertiary alkyl amines is a mixture of tertiary primary amines.

Concentrates and Other Compositions and Uses

In accordance with one aspect of the invention, the thiazole reaction product can be incorporated as an additive into lubricating compositions in an effective amount to impart adequate extreme pressure properties. In this context, adequate extreme pressure properties can be described as passing a Timken Load of at least 22.7 kg (50 pounds), or at least 27.2 kg (60 pounds). It is also desirable to have a D2509 kg Weld result as high as possible, with a result of 300 kg being desirable and a result over 500 kg being considered superior. As will be apparent with one skilled in the art, the amount of the reaction product needed to provide adequate extreme pressure properties is variable. The additive can be added in a range from 0.1 to 10 weight percent of the lubricating composition, and in another embodiment from 0.5% to 5% by weight, and in yet another embodiment from 1% to 4% by weight.

Lubricating compositions suitable for incorporation of the extreme pressure additives include, but are not limited to, lubricating oils, engine oils and lubricating greases containing a major amount of base oil. A "major amount" in this context means that greater than 50% by weight of the composition is base oil.

In accordance with another aspect of the invention, the thiazole reaction product may added to compositions that comprise additional lubricating additives to form additive concentrates.

The various additives described herein can be added directly to the lubricant compositions. In one embodiment, however, they can be diluted with a concentrate-forming amount of a substantially inert, normally liquid organic diluent such as mineral oil or a synthetic oil such as a polyalphaolefin to form an additive concentrate. These concentrates usually comprise 0.1 to 80% by weight of the compositions of this invention and may contain, in addition, one or more other additives known in the art or described below. Concentrations such as 15%, 20%, 30% or 50% of the additives or higher may be employed. By a "concentrate forming amount" it is generally meant to be an amount of oil or other solvent less than the amount present in a fully formulated lubricant, e.g., less than 85% or 80% or 70% or 60%. Additive concentrates can be prepared by mixing together the desired components, often at elevated temperatures, usually up to 150° C. or 130° C. or 115° C.

In one embodiment, the lubricating composition is a grease. Various other additives may be incorporated into the grease compositions as well. The invention also comprises a use for these compositions wherein the composition imparts to a grease an improvement in extreme pressure properties, antiwear properties, or both.

In preparing the grease composition, the thiazole reaction product may be mixed with an oil of lubricating viscosity under grease-forming conditions of heating and mixing known in the art. In another embodiment, the thiazole reaction product can be mixed with a pre-formed grease composition. These processes may also include the addition of a grease thickening agent with the thiazole reaction product.

Grease thickening agents are well known in the art. Suitable thickening agents for use in this invention include but are not limited to simple metal soap thickeners, soap complexes, non-soap thickeners, metal salts of such acid-functionalized oils, polyurea and diurea thickeners, calcium sulfonate thickeners or combinations thereof.

Additional Additives

Additional components may be used in preparing a lubricant according to the present invention, for instance, those additives typically employed in a crankcase lubricant, a grease composition, a gear oil, a hydraulic fluid, an automatic transmission fluid, and other lubricants as well. These lubricants may typically contain any or all of the following components hereinafter described.

These additional additives include but are not limited to additional extreme pressure (EP) and/or anti-wear additives, metal deactivators, dispersants, antifoams, corrosion rust inhibitors, antioxidants, detergents, polymers and functionalized polymers and others useful additives for providing enhanced performance characteristics of the composition and are known in the art. The number, type and amount of additional additive depends on the specific performance characteristics designed for the composition and is generally in the range of 0.1% to 75%, in one embodiment from 0.5% to 60%, and in another embodiment from 1% to 20% of the composition, all percentages being percents by weight.

Additional extreme pressure anti-wear additives that may be used in the invention include but are not limited to a sulfur or chlorosulphur EP agent, a chlorinated hydrocarbon EP agent, or a phosphorus EP agent, or mixtures thereof. Examples of such EP agents are chlorinated wax, organic sulfides and polysulfides, such as benzyldisulfide, bis-(chlorobenzyl)disulfide, dibutyl tetrasulfide, sulfurized sperm oil, sulfurized vegetable and or animal oils, sulfurized methyl ester of oleic acid, sulfurized alkylphenol, sulfurized dipentene, sulfurized terpene, and sulfurized Diels-Alder adducts; phosphosulfurized hydrocarbons, such as the reaction product of phosphorus sulfide with turpentine or methyl oleate, phosphorus esters such as the dihydrocarbon and trihydrocarbon phosphites, i.e., dibutyl phosphite, diheptyl phosphite, dicyclohexyl phosphite, pentylphenyl phosphite; dipentylphenyl phosphite, tridecyl phosphite, distearyl phosphite and polypropylene substituted phenol phosphite, metal thiocarbamates, such as zinc dioctyldithiocarbamate, zinc di-2-ethylhexyl phosphorodithioate and the zinc salts of a phosphorodithioic acid. Additionally, dithiophosphate and dithiocarbamate esters and disulfides, and mixtures of mono- and dialkylphosphates salted with alkyl amines may also be used. Combinations of the above may be used. These additional EP agents are present in one embodiment in the range of 0% to 12%, in another embodiment from 0.5% to 10% and in yet another embodiment from 1% to 6% by weight of the composition. In one embodiment, the present invention may be used with a sulfurized olefin, such as sulfurized isobutylene.

Solid additives in a particle or finely divided form may also be used at levels of 0% to 20% by weight. These include but are not limited to graphite, molybdenum disulfide, zinc oxide, boron nitride, polytetrafluoroethylene, and the like. Mixtures of solid additives may also be used.

Oil soluble polymers and functionalized polymers may also be used in the compositions of the invention and include but are not limited to polyisobutenes, polymethyacrylate acid esters, polyacrylate acid esters, hydrogenated diene polymers, polyalkyl styrenes, hydrogenated alkenyl aryl conjugated diene copolymers, polyolefins and multifunctional viscosity improvers, including dispersent viscosity modifiers (which impart both dispersancy and viscosity improvement). The polymers may also be used to provide tackiness to the lubricant composition. Combinations may be used.

The oil soluble polymers, including functionalized polymers, can be present, in one embodiment, in the range of 0% to 50%, in another embodiment from 0.01% to 25%, and in yet another embodiment from 0.02% to 18% by weight of composition.

Antioxidants suitable for use in the invention are known in the art and include but are not limited to phenate sulfides, phosphosulfurized terpenes, sulfurized olefins, aromatic amines, and hindered phenols. Another example of an antioxidant is a hindered, ester-substituted phenol, which can be prepared by heating a 2,6-dialkylphenol with an acrylate ester under base catalysis conditions, such as aqueous KOH. Combinations may be used. The antioxidants may be present in the range of 0% to 10%, in another embodiment from 0.25% to 6%, and in yet another embodiment from 0.5% to 3% by weight of the composition.

Metal deactivators useful in lubricating oil compositions are known in the art and include but are not limited to benzotriazole, benzimidazole, 2-alkyldithiobenzimidazoles, 2-alkyldithiobenzothiazoles, 2-(N,N-dialkyldithiocarbamoyl)benzothiazoles, 2,5-bis(alkyl-dithio)-1,3,4-thiadiazoles, and 2,5-bis(N,N-dialkyldithiocarbamoyl)-1,3,4-thiadiazoles. Combinations may be used. The metal deactivators are present in the range of 0% to about 5% preferably about 0.1% to about 4% and more preferably about 0.2% to about 3% by weight of the emulsified composition.

Detergents are known in the art and include but are not limited to overbased materials prepared by reacting an acidic material (typically an inorganic acid or lower carboxylic acid, preferably carbon dioxide) with a mixture comprising an acidic organic compound, a reaction medium comprising at least one inert, organic solvent (mineral oil, naphtha, toluene, xylene, etc.) for said acidic organic material, a stoichiometric excess of a metal base, and a promoter. The acidic organic compounds useful in making overbased compositions in general can include carboxylic acids, sulfonic acids, phosphorus-containing acids, phenols or mixtures of two or more thereof.

The metal compounds useful in making the basic metal salts are generally any Group I or Group II metal compounds (CAS version of the Periodic Table of the Elements). The Group I metals of the metal compound include alkali metals (group IA: sodium, potassium, lithium, etc.) as well as Group IB metals such as copper. The Group I metals are preferably sodium, potassium, lithium and copper, more preferably sodium or potassium, and more preferably sodium. The Group II metals of the metal base include the alkaline earth metals (group IIA: magnesium, calcium, barium, etc.) as well as the Group IIB metals such as zinc or cadmium. Preferably the Group II metals are magnesium, calcium, or zinc, preferably magnesium or calcium, more preferably calcium. Generally the metal compounds are delivered as metal bases or metal salts. The anionic portion of the compound can be hydroxide, oxide, carbonate, borate, nitrate, etc.

While overbased metal salts can be prepared by combining an appropriate amount of metal base and organic acid substrate, the formation of useful overbased compositions is facilitated by the presence of an additional acidic material. The acidic material can be a liquid such as formic acid, acetic acid, nitric acid, etc, often in the presence of carbon dioxide.

A promoter is a chemical employed to facilitate the incorporation of metal into the basic metal compositions. The promoters are quite diverse and are well known in the art, as evidenced by the cited patents. These include but are not limited to the alcoholic and phenolic promoters. The alcoholic promoters include the alkanols of one to about twelve carbon atoms such as methanol, ethanol, isobutyl alcohol, amyl alcohol, octanol, isopropyl alcohol, and mixtures of these and the like. Phenolic promoters include a variety of hydroxy-substituted benzenes and naphthalenes. Mixtures of various promoters are sometimes used. The promoters are found in U.S. Pat. Nos. 2,777,874 and 2,616,904.

Combinations of detergents may be used. The detergents may be present in the range of 0% to 8%, in another embodiment from 0.1% to 6%, and in yet another embodiment from 0.3% to 5% by weight of composition.

Antifoams are known in the art and include but are not limited to organic silicones such as dimethyl silicone and the like. Combinations may be used. The antifoams can be present in the range of 0% to 2%, in another embodiment from 0.01% to 1%, and in yet another embodiment from 0.02% to about 0.7% by weight of the composition.

Antirust compounds are known in the art and include but are not limited to alkyl substituted aliphatic dicarboxylic acids such as alkenyl and succinic acids, sulfonates relating to the metal detergent, sodium nitrite, calcium salts of oxidized paraffin wax, magnesium salts of oxidized paraffin wax, alkali metal salts, alkaline earth metal salts or amine salts of beef tallow fatty acids, alkenyl succinates or alkenyl succinic acid half esters (whose alkenyl moiety has a molecular weight of about 100 to 300), glycerol monoesters, nonylphenyl ethoxylate, lanolin fatty acid esters, and calcium salts of lanolin fatty acids. Combinations may be used. The antirust compounds are present in the range of about 0% to about 10%, preferably about 0.1% to about 8%, and more preferably 0.2% to about 6% by weight of the composition.

The lubricating compositions of the present invention may thus impart protection against deterioration in one or more of the properties of engine performance, engine wear, engine cleanliness, deposit control, filterability, and oxidation of engine oils, when they are used to lubricate a surface of a mechanical device such as an engine drive train, for instance, the moving parts of a drive train in a vehicle including an internal surface a component of an internal combustion engine. Such a surface may then be said to contain a coating of the lubricant composition.

The internal combustion engines to be lubricated may include gasoline fueled engines, spark ignited engines, diesel engines, compression ignited engines, two-stroke cycle engines, four-stroke cycle engines, sump-lubricated engines, fuel-lubricated engines, natural gas-fueled engines, marine diesel engines, and stationary engines. The vehicles in which such engines may be employed include automobiles, trucks, off-road vehicles, marine vehicles, motorcycles, all-terrain vehicles, and snowmobiles. In one embodiment, the lubricated engine is a heavy duty diesel engine, which may include sump-lubricated, two- or four-stroke cycle engines, which are well known to those skilled in the art. Such engines may have an engine displacement of greater than 3, greater than 5, or greater than 7 L.

As used herein, the term "hydrocarbyl substituent" or "hydrocarbyl group" is used in its ordinary sense, which is well-known to those skilled in the art. Specifically, it refers to a group having a carbon atom directly attached to the remainder of the molecule and having predominantly hydrocarbon character. Examples of hydrocarbyl groups include:

hydrocarbon substituents, that is, aliphatic (e.g., alkyl or alkenyl), alicyclic (e.g., cycloalkyl, cycloalkenyl) substituents, and aromatic-, aliphatic-, and alicyclic-substituted aromatic substituents, as well as cyclic substituents wherein the ring is completed through another portion of the molecule (e.g., two substituents together form a ring), including saturated and unsaturated groups;

substituted hydrocarbon substituents, that is, substituents containing non-hydrocarbon groups which, in the context of this invention, do not alter the predominantly hydrocarbon nature of the substituent (e.g., halo (especially chloro and fluoro), hydroxy, alkoxy, mercapto, alkylmercapto, nitro, nitroso, and sulfoxy);

hetero substituents, that is, substituents which, while having a predominantly hydrocarbon character, in the context of this invention, contain other than carbon in a ring or chain otherwise composed of carbon atoms. Heteroatoms include sulfur, oxygen, nitrogen. Hetero substituents encompass pyridyl, furyl, thienyl and imidazolyl substituents. In general, no more than two, preferably no more than one, non-hydrocarbon substituent will be present for every ten carbon atoms in the hydrocarbyl group; typically, there will be no non-hydrocarbon substituents in the hydrocarbyl group.

It is known that some of the materials described above may interact in the final formulation, so that the components of the final formulation may be different from those that are initially added. For instance, metal ions (of, e.g., a detergent) can migrate to other acidic or anionic sites of other molecules. The products formed thereby, including the products formed upon employing the composition of the present invention in its intended use, may not be susceptible of easy description. Nevertheless, all such modifications and reaction products are included within the scope of the present invention; the present invention encompasses the composition prepared by admixing the components described above.

EXAMPLES

The following non-limiting examples illustrate the synthesis of the thiazole reaction products, and their use as extreme pressure additives in lubricating compositions.

Comparative Example 1

A reaction product is prepared by adding 1.9 moles of 1,3,4-thiadiazole-2,5-bis(tert-nonyldithio) to 1.0 moles of oleic acid, mixing the materials at room temperature. The mixture is then warmed to 60 degrees Celsius and 6.5 moles of Primene 81R™ (a mixture of $C_{11}$-$C_{14}$ tertiary alkyl primary amines) is added over 10 minutes. The mixture is then heated to 115 degrees Celsius and held with mixing until no solids are visible. The clear liquid product is then collected.

Comparative Example 2

The same procedure as Comparative Example 1 is followed except that 1.2 moles of tolytriazole is mixed with 1.0 moles of oleic acid and 2.0 moles of Primene 81R™.

Example 1

The same procedure as Comparative Example 1 is followed except that 1.0 moles of 2,5-dimercapto-1,3,4-thiadiazole is mixed with 1.1 moles of oleic acid and 2.0 moles of Primene 81R™ giving a dark liquid.

Example 2

The same procedure as Comparative Example 1 is followed except that 1.0 moles of 2,5-dimercapto-1,3,4-thiadiazole is mixed with 1.0 moles of oleic acid and 1.0 moles of Primene 81R™ giving a dark liquid.

Example 3

The same procedure as Example 1 is followed except that 1.0 moles of 2,5-dimercapto-1,3,4-thiadiazole is mixed with 1.1 moles of oleic acid and 2.0 moles of Bis-2-ethylhexyl amine giving a dark solid.

Example 4

The same procedure as Example 1 is followed except that 1.0 moles of 2,5-dimercapto-1,3,4-thiadiazole is mixed with 1.1 moles of oleic acid and 1.9 moles of Oleylamine giving a viscous liquid.

Example 5

The same procedure as Example 1 is followed except that 1.1 moles of 2,5-dimercapto-1,3,4-thiadiazole is mixed with 1.0 moles of isostearic acid and 1.1 moles of Primene 81R™.

Example 6

The same procedure as Example 1 is followed except that 1.0 moles of 2,5-dimercapto-1,3,4-thiadiazole is mixed with 1.0 moles of isostearic acid and 2.0 moles of Primene 81R™.

Example 7

The same procedure as Example 1 is followed except that 1.0 moles of 2,5-dimercapto-1,3,4-thiadiazole is mixed with 1.0 moles of 12-hydroxystearic acid and 2.0 moles of Primene 81R™.

Example 8

The same procedure as Example 1 is followed except that 1.7 moles of 2,5-dimercapto-1,3,4-thiadiazole is mixed with 1.0 moles of polypropenylsuccinic acid and 3.5 moles of Primene 81R™.

Example 9

The same procedure as Example 1 is followed except that 1.0 moles of 2,5-dimercapto-1,3,4-thiadiazole is mixed with 1.0 moles of levulinic acid and 1.0 moles of Primene 81R™.

Example 10

The same procedure as Example 1 is followed except that 1.0 moles of 2,5-dimercapto-1,3,4-thiadiazole is mixed with 1.3 moles of the Primene 81R™ salt of phosphorylated hydroxyalkylated dithiophosphoric ester phosphoric acid and 1.1 moles of Primene 81R™.

Example 11

The same procedure as Example 1 is followed except that 1.3 moles of 2,5-dimercapto-1,3,4-thiadiazole is mixed with 1.0 moles of the Primene 81R™ salt of C14-16 ester of phosphoric acid and 1.4 moles of Primene 81R™.

Example 12

The same procedure as Comparative Example 1 is followed except that 0.7 moles of 2,5-dimercapto-1,3,4-thiadiazole is mixed with 0.7 moles of oleic acid, 0.9 moles of 85% phosphoric acid, and 0.7 moles of Primene 81R™ giving a dark viscous liquid.

Example 13

The same procedure as Comparative Example 1 is followed except that 0.7 moles of 2,5-dimercapto-1,3,4-thiadiazole is mixed with 0.7 moles of isostearic acid, 0.9 moles of 85% phosphoric acid, and 0.7 moles of Primene 81R™ giving a light viscous liquid.

The various examples are tested in lithium based greases to assess the EP performance. The examples are used as additives in a Lithium grease and a Lithium complex grease where the Lithium complex grease is prepared using an additional acid, known as a complexing acid. The additives are added to the greases at the levels indicated below and then tested for OK load, by ASTM procedure D2509, and Weld load, by ASTM procedure D2596. One grease sample is prepared by adding material from Example 1 and a sulfurized olefin to a Lithium grease. The results are provided in the following table:

TABLE 1

Extreme Pressure Test Results

| Grease Sample | Grease Type | Additives Used | Percent by wt | D2509 OK load, lb | D2596 Weld load, kg |
|---|---|---|---|---|---|
| A | Li Grease | Comparative 1 | 4 | 45 | — |
| B | Li Grease | Comparative 2 | 4 | <30 | 250 |
| C | Li Grease | Example 1 | 4 | 90 | 250 |
| D | Li Grease | Example 3 | 4 | <10 | 200 |
| E | Li Grease | Example 4 | 4 | <50 | 315 |
| F | Li Grease | Example 5 | 4 | 70 | 315 |
| G | Li Grease | Example 6 | 4 | 65 | 315 |
| H | Li Grease | Example 8 | 4 | 65 | 315 |
| I | Li Grease | Example 10 | 4 | 80 | 315 |
| J | Li Grease | Example 1 | 2 | 65 | 400 |
| | | Sulfurized Olefin | 2 | | |
| K | Li Complex | Example 2 | 4 | 80 | 500 |
| L | Li Complex | Example 5 | 4 | 75 | 315 |
| M | Li Complex | Example 7 | 4 | 60 | 200 |
| N | Li Complex | Example 9 | 4 | 65 | 315 |
| O | Li Complex | Example 10 | 4 | 80 | 400 |
| P | Li Complex | Example 11 | 4 | 60 | — |
| Q | Li Complex | Example 12 | 4 | 80 | 620 |
| R | Li Complex | Example 13 | 4 | 70 | 400 |

Each of the documents referred to above is incorporated herein by reference. Except in the Examples, or where otherwise explicitly indicated, all numerical quantities in this description specifying amounts of materials, reaction conditions, molecular weights, number of carbon atoms, and the like, are to be understood as modified by the word "about." Unless otherwise indicated, each chemical or composition referred to herein should be interpreted as being a commercial grade material which may contain the isomers, by-products, derivatives, and other such materials which are normally understood to be present in the commercial grade. However, the amount of each chemical component is presented exclusive of any solvent or diluent oil, which may be customarily present in the commercial material, unless otherwise indicated. It is to be understood that the upper and lower amount, range, and ratio limits set forth herein may be independently combined. Similarly, the ranges and amounts for each element of the invention can be used together with ranges or amounts for any of the other elements. As used herein, the expression "consisting essentially of" permits the inclusion of substances that do not materially affect the basic and novel characteristics of the composition under consideration.

What is claimed is:

1. A lubricating composition comprising an oil of lubricating viscosity and the reaction product of:

(a) an unsubstituted thiazole;

(b) a composition comprising at least one of the following:

(i) a carboxylic acid or anhydride with at least one hydrocarbon group of 2 to 75 carbon atoms;

(ii) a phosphorus acid or salt; and (c) an amine;

wherein component (c) comprises: 2-ethylhexylamine, 3-aminoheptane, tert-octylamine, 1,5-dimethylhexylamine, N-methylhexylamine, 1,3-dimethylbutylamine, a mixture of tertiary alkyl amines where the alkyl groups contain from 12 to 14 carbon atoms, or mixtures thereof; and wherein component (a) comprises an unsubstituted dimercaptothiadiazole, an unsubstituted mercaptobenzothiazole, or combinations thereof; and wherein component (a) is free of polymers of dimercaptothiadiazoles.

2. The composition of claim 1 wherein component (a) comprises 2,5-dimercapto-1,3,4-thiadiazole, 5-amino-1,3,4-thidiazole-2-thiol, 5-methyl-1,3,4-thiadiazole-2-thiol, 5-methylthio-1,3,4-thiadiazole-2-thiol, or combinations thereof.

3. The composition of claim 1 wherein component (b)(i) comprises a hydrocarbon-substituted succinic acid or anhydride.

4. The composition of claim 1 wherein component (b)(i) comprises a mono-carboxylic acid.

5. The composition of claim 1 wherein component (b) comprises isostearic acid, oleic acid, 12-hydroxystearic acid, polypropylene succinic acid, polyisobutylene succinic acid, citronellic acid, linoleic acid, levulinic acid, or mixtures thereof.

6. The composition of claim 1 wherein component (b)(ii) comprises phosphoric acid, phosphonic acid, alkyl amine salts of mono and di esters of phosphoric acid or phosphonic acid, wherein the alkyl groups of the amines contain up to 60 carbon atoms, or mixtures thereof.

7. The composition of claim 1 further comprising at least one compound selected from the group consisting of an antiwear agent, an antioxidant, a metal deactivator, a rust inhibitor, a viscosity modifier and an extreme pressure additive.

8. The composition of claim 1 where the lubricating composition is a grease which further comprises a thickening agent selected from the group consisting of simple metal soap thickeners, soap complexes, non-soap thickeners, metal salts of such acid-functionalized oils, polyurea and diurea thickeners, overbased calcium sulfonate thickeners or combinations thereof.

9. A process for preparing a grease composition comprising combining under grease-forming conditions of heating and mixing:

I. an oil of lubricating viscosity; and

II. a reaction product of:

(a) an unsubstituted thiazole (b) a composition comprising at least one of the following:

(i) a carboxylic acid with at least one hydrocarbon group of 2 to 75 carbon atoms;

(ii) a phosphorus acid or salt; and (c) an amine;

wherein component (c) comprises: 2-ethylhexylamine, 3-aminoheptane, tert-octylamine, 1,5-dimethylhexylamine, N-methylhexylamine, 1,3-dimethylbutylamine, a mixture of tertiary alkyl amines where the alkyl groups contain from 12 to 14 carbon atoms, or mixtures thereof; and wherein component (a) comprises an unsubstituted dimercaptothiadiazole, an unsubstituted mercaptobenzothiazole, or combinations thereof; and wherein component (a) is free of polymers of dimercaptothiadiazoles; and optionally III. a thickening agent selected from the group consisting of simple metal soap thickeners, soap complexes, non-soap thickeners, metal salts of such acid-functionalized oils, polyurea and diurea thickeners, overbased calcium sulfonate thickeners or combinations thereof.

10. A process for preparing a grease composition comprising mixing:

I. a grease composition; and

II. a reaction product of:

(a) an unsubstituted thiazole (b) a composition comprising at least one of the following:

(i) a carboxylic acid with at least one hydrocarbon group of 2 to 75 carbon atoms;

(ii) a phosphorus acid or salt; and (c) an amine;

wherein component (c) comprises: 2-ethylhexylamine, 3-aminoheptane, tert-octylamine, 1,5-dimethylhexylamine, N-methylhexylamine, 1,3-dimethylbutylamine, a mixture of tertiary alkyl amines where the alkyl groups contain from 12 to 14 carbon atoms, or mixtures thereof; and wherein component (a) comprises an unsubstituted dimercaptothiadiazole, an unsubstituted mercaptobenzothiazole, or combinations thereof and wherein component (a) is free of polymers of dimercaptothiadiazoles.

* * * * *